United States Patent [19]

Chiarelli et al.

[11] Patent Number: 5,052,305

[45] Date of Patent: Oct. 1, 1991

[54] SUBCALIBER PROJECTILE INCLUDING A CORE, A SABOT AND A SLEEVE

[75] Inventors: François A. Chiarelli, Bourges; Jean-Louis Chazeirat, la Chapelle Saint Ursin; Jean-Pierre Boisnard, Bourges, all of France

[73] Assignee: Etat Francais represented by the Delegue general pour l'armement, Armees, France

[21] Appl. No.: 603,549

[22] Filed: Oct. 26, 1990

[30] Foreign Application Priority Data

Oct. 26, 1989 [FR] France ..... 89 14034

[51] Int. Cl.[5] ..... F42B 14/06

[52] U.S. Cl. ..... 102/522; 102/523

[58] Field of Search ..... 102/520–523

[56] References Cited

U.S. PATENT DOCUMENTS

| | | | |
|---|---|---|---|
| 3,435,768 | 4/1969 | Engel | 102/523 |
| 3,927,618 | 12/1975 | Engel | 102/523 |
| 4,841,867 | 1/1989 | Garrett | 102/520 |
| 4,846,072 | 11/1989 | Rossmann | 102/520 |

*Primary Examiner*—Harold J. Tudor

*Attorney, Agent, or Firm*—Parkhurst, Wendel & Rossi

[57] ABSTRACT

The technical field of the invention is that of spin-stabilized subcaliber projectiles including a core integral with a sabot, and a sleeve.

The sleeve includes a rear annular area lodged in a corresponding groove in the sabot and providing gas-tightness, wherein:

- the sabot includes, toward the front of the projectile, a cylindrical crown having an edge bordering the band groove;
- the crown includes at least three notches, separated by castellations, and extending axially at least to the band groove;
- the sleeve follows a profile complementary to that of the sabot, so that it enters into the notches;
- and the projectile possesses means for separating the sleeve into several sectors under the effect of the centrifugal force, at the time the projectile leaves the gun muzzle.

Application to medium-caliber ammunition.

10 Claims, 4 Drawing Sheets

19

1
3
5
12
11
20
2
1
1
14
23
9
4
10
7
13
8
6
24
15
25

SUBCALIBER PROJECTILE INCLUDING A CORE, A SABOT AND A SLEEVE

BACKGROUND OF THE INVENTION

1. Field of the Invention

The present invention relates to the field of spin-stabilized subcaliber projectiles including a core integral with a sabot and with a sleeve.

2. Description of the Prior Art

Such projectiles include a core of a dense material such as tungsten, which is made integral in rotation with a sabot of the gun caliber size. The sabot carries a seal band which takes hold in the gun barrel rifling and imparts the rotation to the core as the projectile travels through the barrel. The sleeve is integral with the sabot and surrounds the core. The function of the sleeve is to secure the core radially and axially, if need be, relative to the sabot.

French patent FR2131393 describes a projectile of this type in which the plastic sleeve is molded over the sabot and core, and includes six regularly distributed fracture initiators, arranged axially.

The band here is integral with the sleeve, to reduce the weight of the sabot and make the projectile easier to manufacture, as only one overmolding operation is needed.

The sabot and core are integrated axially by clips on the sabot, which fit into the groove arranged on the rear part of the core.

However, the difficulty there is in perfecting such a sleeve-sabot joint is due to the necessary compromise between the resistance of the joint to the stresses of firing, while it must be sufficiently fragile to release the core rapidly when exiting from the gun muzzle.

Any mistake may result in the sleeve breaking inside the tube, with the risk of this break propagating to the band and thereby allowing a gas leakage which is harmful to the later ballistics of the projectile.

And yet reinforcing the thickness of the sleeve in the area where it joins with the part constituing the band runs the risk of hindering the separation of the sleeve and sabot, and thereby the release of the core.

The purpose of the invention is to propose a subcaliber projectile that will remedy these disadavantages.

SUMMARY OF THE INVENTION

Thus the object of the invention is a subcaliber spin-stabilized projectile intended to be fired from a gun, and of the type including a core arranged in the bore of a sabot, and a sleeve, wherein the sleeve includes an annular area in the rear part, which is lodged in a corresponding groove in the sabot and constitutes a gastight band. The sabot includes a cylindrical crown on its forward end. The crown possesses an edge that delimits the band groove, as well as three notches, separated by castellations, which extend axially at least to the band groove. The sleeve follows a profile that is complementary to that of the sabot, so that it penetrates inside these notches and the projectile thereby possesses means ensuring the separation of the sleeve into several sectors when it leaves the gun muzzle, under the effect of the centrifugal force.

The edge separates the band portion cleanly from the rest of the sleeve, which ensures the band strength. The castellations integrate the two parts of this sleeve, distinguished by the edge.

According to another feature, the means ensuring the separation include fracture initiators in the form of valleys of reduced thickness on the sleeve. These initiations extend from the sabot castellations axially over roughly the entire length of the sleeve, and are distributed at regular angles. The set of "fracture" half planes, which are defined as the half planes passing through the projectile's centerline and containing one fracture initiator, also define "main radial" half planes, which are the half planes bisecting the dihedron formed by two adjacent fracture half planes. The notches are distributed in such a way that they are all symmetrical with respect to some main radial half plane, and also, if the main half planes cut through the castellations, the width of the said castellations does not decrease readially inward in the sabot; and in the case where the main half planes cut through the notches, the width of these notches does not increase radially outward in the sabot.

Since the fracture intitiations start at the castellations, any crack beginning at their level inside the gun barrel will not propagate to the band.

The notch distribution proposed relative to the fracture initiations on the sleeve, as well as their width variation rules, ensure that the sleeve will separate into several sectors when it exits from the gun muzzle.

According to other features, each notch is delimited by two flat surfaces, parallel to each other and to the projectile centerline, and the castellations separating notches that are nonparallel with each other are delimited by two concurrent planar surfaces at the level of a generatrix of the cylindrical bore surface.

The sabot may possess in all three pairs of notches and three main radial half planes, with the two notches of a pair being arranged symmetrically to either side of a main radial half plane.

The sleeve may carry radial ribs arranged on its outer surface and extending axially over roughly the entire length of the sleeve, and the ribs will be arranged angularly at the level of the main radial half planes, all of the ribs being symmetrical with respect to any given main radial half plane.

The sleeve may include three pairs of ribs.

The fracture initiators may be provided on an internal surface of the sleeve.

The sabot may include a knurled profile in the bottom of the band groove, and the notches may extend to this knurled profile.

BRIEF DESCRIPTION OF THE DRAWING

A better understanding of the present invention may be had from the consideration of the following description of embodiments, taken in conjunction with the accompanying drawing in which.

FIRST EMBODIMENT

Figure 1:
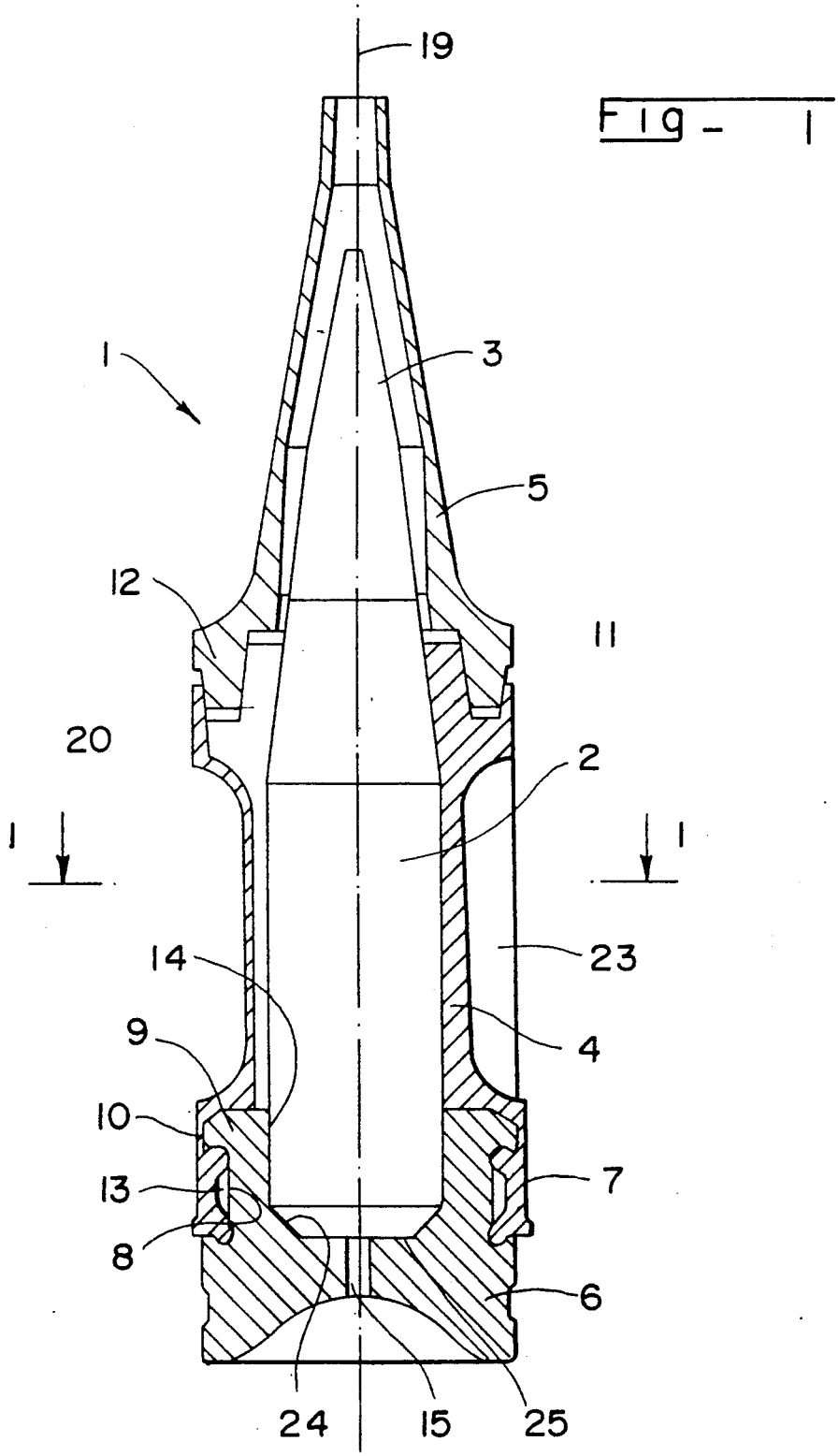
FIG. 1 is a simplified overall axial sectional view of a subcaliber projectile in accordance with the invention.

Referring to FIG. 1, a projectile 1 of the subcaliber spin-stabilized type includes a core 2 consisting of a body of heavy material, e.g. tungsten, ending in the front with a ballistic ogive nose 3 of aluminum alloy.

The core is arranged in a bore 14 in sabot 6, also made of aluminum alloy. This bore terminates with a conical lodging 24 in which a conical rear portion of the core is seated.

The core is held in contact with the sabot 6 by a sleeve 4 of plastic material (e.g. nylon). The grooves, not shown, are provided on the rear face 25 of the core to integrate the sabot and core in rotation, by a known technique.

The core also carries with it a tracer composition (not shown) arranged inside a bore (not shown) in its rear part. The tracer composition is ignited by the gases of combustion of the propulsive charge inside the gun, which reach it through an orifice 15.

The plastic sleeve is injected directly onto the aluminum sabot. On its front part, the sleeve carries deformable lips 11, not shown in detail, which press against the conical portion of the core so as to hold the rear part of the core in contact with the sabot (this is especially important at the time the projectile is being fed into an automatic weapon).

The lips 11 are held pressed against the forward conical portion of the core by means of a wedge-shaped portion of a false nose 5, also made of plastic material and made integral with the sleeve by an arbitrary joining means, e.g. by ultrasonic welding.

This false nose possesses known means (such as fracture initiations) for ensuring its own fragmentation when it leaves the weapon muzzle, and this means will not be described in any further detail.

The sleeve includes a rear zone 7 which fits into a peripheral groove 8 on the sabot, to provide a gastight seal band against leakage of the propulsive gases.

A knurled profile 13 is provided in the valley of this groove 8 to integrate the sleeve in rotation with the sabot.

The sabot 6 carries a cylindrical crown 9 with an internal cylindrical surface constituting the bore 14, and which presents an edge 10 delimiting the peripheral groove of the sabot 8 on the forward side.

This edge 10 provides a groove profile 8 that is roughly trapezoidal, and which is particularly well suited to securing a projectile band.

Figure 2:
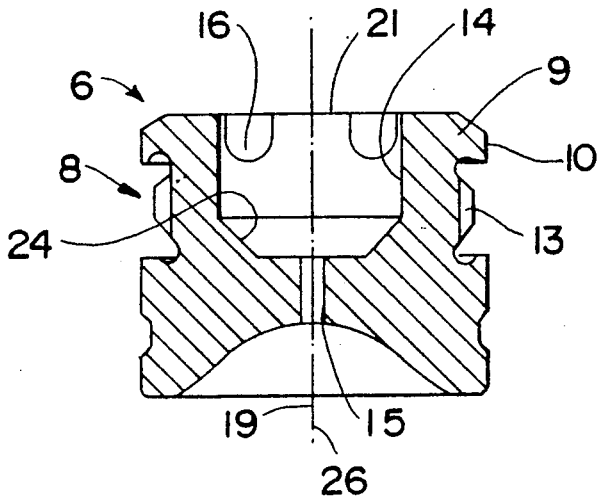
FIG. 2 is a view of a first embodiment of the sabot, shown alone in the sectional plane B—B of FIG. 3.
Figure 3:
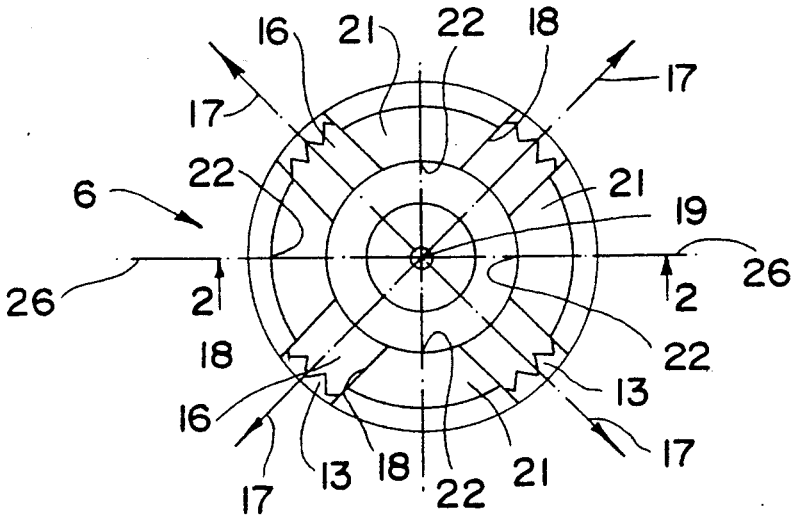
FIG. 3 is a top view of this same sabot.

Referring to FIGS. 2 and 3, it may be noted that the cylindrical crown 9 possesses four notches 16, distributed at regular angles, and separated by four castellations 21. These notches extend axially as far as the groove 8, and preferably do not reach the knurled profile 13, so as not to weaken the means for joining the sabot and sleeve in rotation.

The profile of the notch valleys 16 is cylindrical here, for convenience in manufacturing (milling); but any other notch valley profile is possible.

Each notch 16 is delimited by two planar surfaces 18, parallel to each other and to the projectile centerline 19; but these planar surfaces may also come together, as will be explained further on.

As the sleeve 4 is molded onto the sabot 6, it possesses a profile that is complementary to that of the sabot and therefore penetrates the notches 16.

The advantage of such a configuration is that it becomes possible to dissociate the functional purpose of the forward part of the sleeve (holding the core) from that of the rear part (constituting the band). The edge 10 provides a separation between the forward part and the band part of the sleeve, thereby improving the strength of the band. The entire sleeve is held together by the presence of sleeve material inside the notches 16.

Therefore the invention combines the advantages of the configuration in which the projectile possesses a band separate from the sleeve (for band strength) with the configuration in which the projectile is equipped with a monobloc sleeve (for convenience in manufacture and the possibility of making a sabot of reduced dimensions).

The invention also makes it possible to avoid the disadvantages of the monobloc structure (risk of propagating fractures between the forward and after parts of the sleeve).

The projectile also includes means for separating the sleeve into several sectors at the time it exits from the weapon barrel, for the purpose of releasing the core without disturbing its trajectory.

Figure 4:
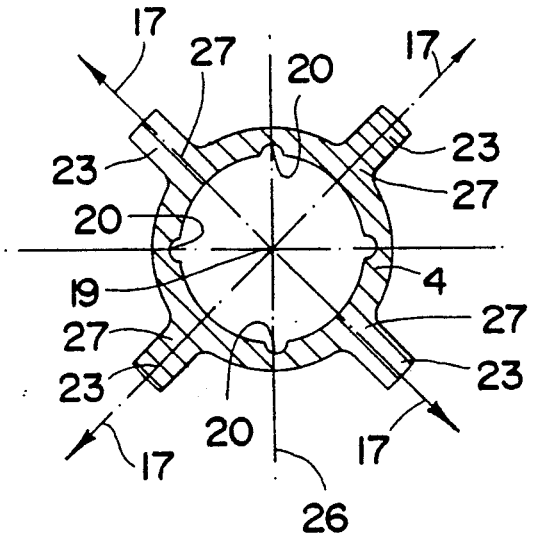
FIG. 4 is a view of the sleeve alone in the sectional plane A—A of FIG. 1.

Referring to FIG. 4, these means include fracture initiators 20 (also visible in FIG. 1), arranged in the form of a reduction in the thickness of the sleeve.

These initiations are arranged on an internal cylindrical surface of the sleeve 4, for the purpose of simplifying the design of the injection mold, and they extend axially starting from the castellations 21 and running roughly over the entire length of the sleeve 4.

As the fracture initiators start at the castellations, the risk is avoided of having a crack in the castellations propagate all the way to the band and causing a gas leak.

In the case of this first embodiment of the invention, there are four fracture initiators 20 on the sleeve, spaced at regular angles.

These fracture initiators define half planes 26, which will hereafter be called fracture half planes, which are the half planes containing the projectile centerline 19 and one fracture initiator 20, and limited by the projectile centerline 19.

The fracture half planes 26 in turn determine other half planes, hereafter called main radial half planes 17, which internally bisect the dihedron formed by two adjacent fracture half planes 26. These main half planes are also limited by the projectile centerline 19.

Since there are as many fracture half planes as there are fracture initiators, there will be as many main half planes 17 as there are fracture initiators, and the main half planes will be distributed at regular angles.

The sleeve portions included between the fracture initiators will constitute the sectors 27 that will be ejected by the centrifugal force at the exit from the weapon barrel.

The sleeve 4 also possesses radial ribs 23, arranged on its external surface and extending axially over roughly the entire length of the sleeve 4.

These ribs 23 are arranged angularly at the level of the main radial half planes 17, all of them being symmetrical with respect to one main radial half plane or another.

The purpose of these ribs is to stiffen the sleeve and guide the projectile through the weapon barrel.

They also constitute flyweights arranged at the level of the main half plane.

Such an arrangement has the consequence of increasing the centrifugal forces exerted on the sleeve at the level of these main half planes at the moment the projectile leaves the weapon, thereby promoting the fragmentation of the sleeve 4 along the lines of the fracture initiator 20.

Referring to FIG. 3, which shows the traces of main half plane 17, it can be seen that all of the notches are symmetrical about any one main radial half plane 17.

The main half planes pass through notches 16, and the angular position of the fracture initiator 20 of the sleeve is given in this FIG. 3 by the trace of a generatrix 22 of the internal cylindrical surface of the bore 14 in sabot 6.

As the planar surfaces 18 delimiting the notches are parallel to each other and to the main half planes 17 associated with them, the sectors 27 are ejected with no excessive resistance, and symmetrically, which ensures a correct release of the core.

Because of the various symmetries adopted in the making of the sabot and sleeve, the sleeve will then be divided into four identical sectors whose centers of gravity will be located (projected onto the plane of FIG. 3) at the level of the notches 16. The main half planes 17 therefore materialize the directions of the resultant centrifugal forces exerted on the various sectors 27.

The surfaces 18 delimiting the notches are parallel with the associated main half plane 17, the material of sleeve 4 contained in the notches 16 will not obstruct the ejection of the sectors 27.

We have already seen that the notches 16 were to extend at least to the band throat 8, without impinging the knurled profile 13.

When the sleeve 4 fragments, the sectors 27 will move outward radially from each other while sliding on the plane surfaces 18 bordering the notches. As these surfaces extend in the band groove 8 as far as the knurling 13, they will constitute fracture initiation for this knurling, thereby making it easier to completely separate the sleeve sectors and release the core.

SECOND EMBODIMENT

Figure 5:
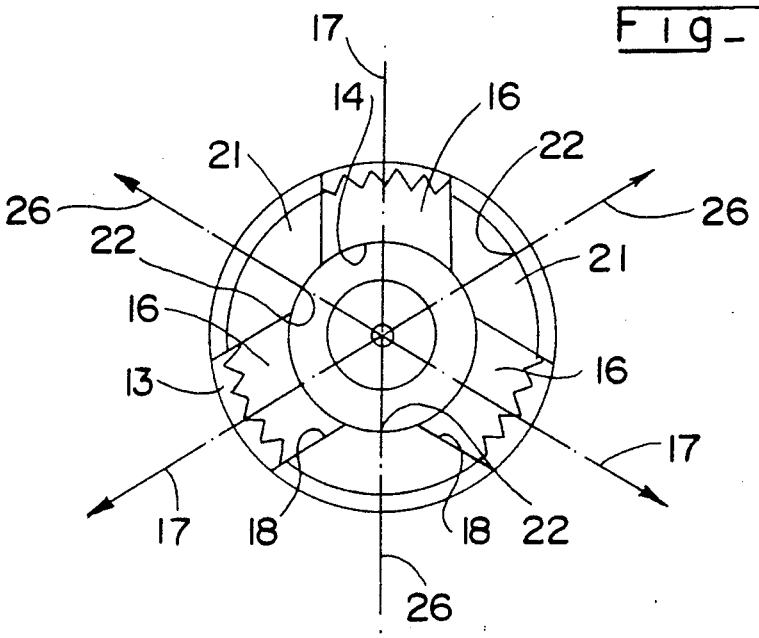
FIGS. 5 and 6 are top views of two variant embodiments of the sabot.

FIG. 5 is a variant in which the sabot 6 has three notches 16.

In such a configuration, the projectile possesses three main half planes 17, separated azimuthally from each other by 120°, and the sleeve also carries three fracture initiators at angular positions that can be seen in FIG. 5 at the level of the generatrices 22, which are intersections of the cylindrical surface of the bore 14 with the fracture half plane 26.

Figure 9:
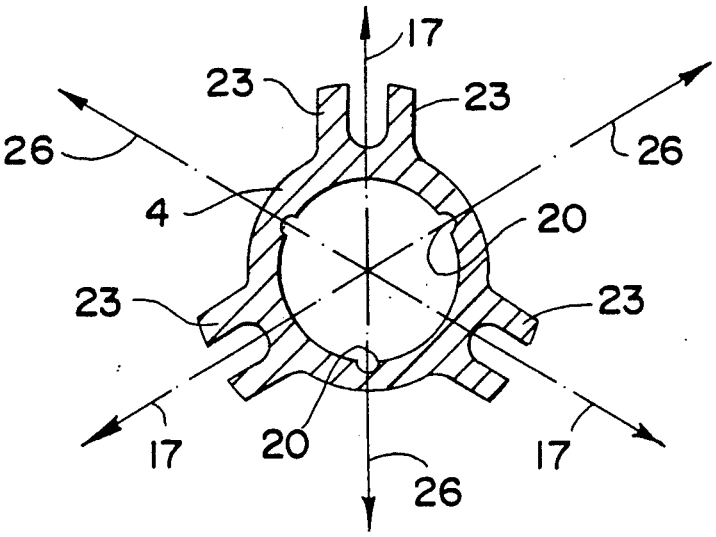
FIG. 9 is a view of the sleeve used with these last three embodiments, seen in the A—A sectional plane of FIG. 1.

FIG. 9 is a view of the sleeve 4 for this embodiment, in the sectional plane A—A of FIG. 1.

This sleeve possesses three pairs of ribs 23, each being arranged symmetrically relative to the main plane 17 considered.

Such an arrangement, by increasing the number of friction points of the sleeve on the weapon barrel, improves the guidance of the projectile inside the barrel without excessively increasing the resultant centrifugal forces exerted on the sleeve sectors.

THIRD EMBODIMENT

Figure 6:
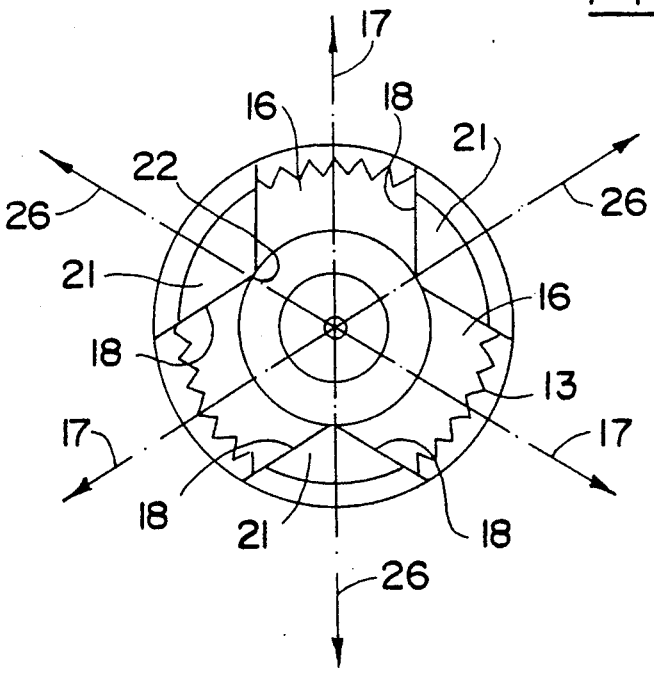

FIG. 6 is a similar variant of the previous embodiment, but in which it is attempted to reduce the sabot weight further by broadening the notches 16.

In this configuration, the castellations 21 separating the notches 16 are delimited by the planar surfaces 18, which come together at the level of the generatrix 22 of the internal cylindrical surface of the bore 14.

Such an arrangement firstly increases the width of the notches and thereby the mechanical strength of this portion of the sleeve, and secondly decreases the frictional forces between the core and the sabot, which makes it easier to separate these two elements.

FIG. 9 again shows the sleeves that can be used with this embodiment.

FOURTH EMBODIMENT

Figure 7:
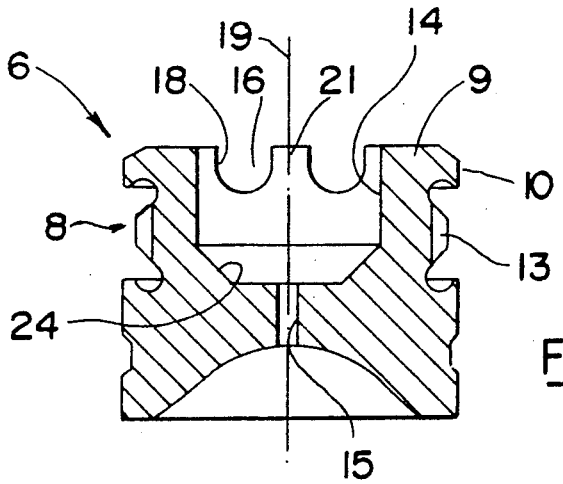
FIG. 7 is a view of another embodiment of the sabot, shown alone in the sectional place C—C of FIG. 8.
Figure 8:
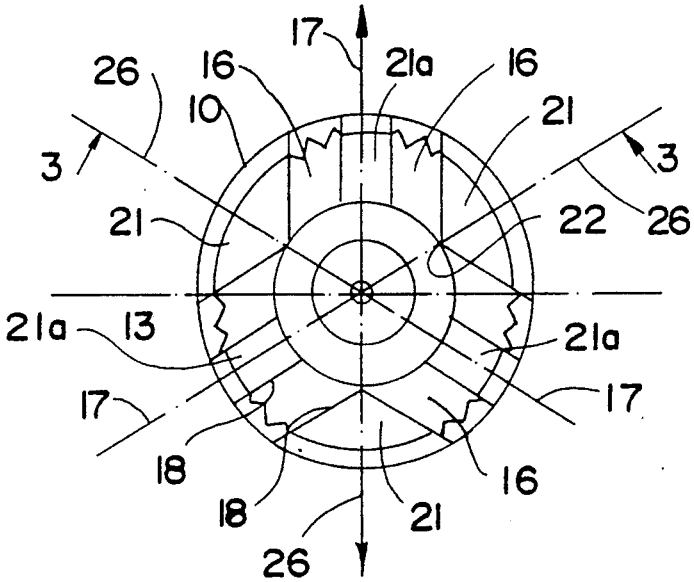
FIG. 8 is a top view of this same sabot.

FIGS. 7 and 8 show one last embodiment of the invention in which the sabot 6 carries three pairs of notches 16.

The sleeve used with this sabot is still the one shown in FIG. 9.

The main half planes 17 here pass through intermediate castellations **21*a*, bounded by planar surfaces 18 parallel with each other and with the main half planes 17** considered.

The two notches 16 constituting a pair are arranged symmetrically to either side of the intermediate castellation **21*a* and of the associated main half plane 17**.

Such a variant lightens the sabot as much as possible without excessively decreasing the circumference of the edge 10 bordering the band groove 8.

In all of the embodiments of the invention described above, the notches are bounded by parallel planar surfaces, which makes it possible to manufacture them by milling.

As has already been pointed out, it would also be possible to define a sabot in which the notches are bounded by concurrent planes. Such notches could be obtained by electro-erosive machining.

In this case, it is necessary to adopt certain notch definition rules, so as not to disturb the separation of the various sleeve sectors.

That is, the notches must first be distributed around the sabot in such a way as they are all symmetrical with respect to any main radial half planes. This ensures that the center of gravity of the sleeve center is actually on the main half plane.

Secondly, if the number of notches adopted is such that the main half planes cut into the castellations (as in the example of FIGS. 7 and 8), the width of these cut castellations must not decrease radially inward, in the sabot. This ensures that the sleeve material located in the notches to either side of the castellation do not obstruct the ejection of the sleeve sectors.

Finally, if the number of notches adopted is such that the main half planes cut into the notches (as in the examples of FIGS. 2 to 6), the width of these cut notches must not decrease radially outward, in the sabot. This is further to ensure that the sleeve sectors separate correctly.

Finally, it would be possible to adopt other means ensuring the separation of the sleeve into sectors when it leaves the weapon barrel.

For example, it would be possible to combine fracture initiations arranged radially on the sleeve, with one or more circular fracture initiators arranged in the vicinity of the sabot (as is mentioned, for example, in French patent 2142897). These fracture initiators would make it possible to separate the various sleeve sectors without disturbing the release of the core, and in this case the part of the sleeve constituting the band would remain attached to the sabot.

What we claim is:

1. A subcaliber spin-stabilized projectile to be fired from a weapon, said projectile comprising a core arranged in the bore of a sabot and a sleeve, said sleeve including a rear annular area lodged in a corresponding band in said sabot to constitute a gastightness band, wherein said sabot includes at its head a cylindrical crown having an edge delimiting said band groove;

said crown having at least three notches, separated by castellations, said notches extending axially from the head of the crown to at least said band groove;

said sleeve having a profile complementary to the profile of said sabot, wherein said sleeve penetrates said notches, and said projectile includes means to ensure separation of said sleeve into several sectors at the time said projectile exits from the weapon barrel, under the effect of centrifugal force.

2. Device of claim 1, wherein the means ensuring separation include:

fracture initiators in the form of thinned portions of the sleeve thickness, and extending from the sabot castellations axially over roughly the entire length of the sleeve, and distributed at regular angles, wherein fracture half planes, which are defined as half planes passing through the projectile centerline and containing a fracture initiator, define in turn main radial half planes, which internally bisect the dihedrons of the fracture half planes;

a distribution of notches such that, firstly, all of the notches are symmetrical about any given main radial half plane, and secondly, in the case where the main radial half planes cut through the castellations, the width of the said cut castellations does not decrease inward radially in the sabot.

3. Device of claim 2, wherein each notch is delimited by two planar surfaces parallel with each other and with the projectile centerline.

4. Device of claim 3, wherein the castellations separating consecutive notches are delimited by two concurrent planar surfaces at the level of a generatrix of the cylindrical surface of said bore of said sabot.

5. Device of claim 4, wherein said sabot includes, in all, three pairs of notches and three main radial half planes, wherein two notches constituting a pair are arranged symmetrically about a main radial half plane.

6. Device of claim 1, wherein said sleeve possesses radial ribs arranged at the level of its external surface and extending axially over roughly the entire length of the sleeve, and wherein said ribs are arranged angularly at the level of the main radial half planes, with all of the ribs being symmetrical with respect to any given main radial half plane.

7. Device of claim 6, wherein said sleeve includes three pairs of ribs.

8. Device of claim 2, wherein the fracture initiators are provided on an internal surface of the sleeve.

9. Device of claim 1, wherein the sabot includes a knurled profile in the valley of the band groove.

10. Device of claim 9, wherein the notches extend fully to the knurled profile.

* * * * *